US007415917B2

(12) United States Patent
Lloyd

(10) Patent No.: US 7,415,917 B2
(45) Date of Patent: Aug. 26, 2008

(54) FIXED DEPLOYED NET FOR HIT-TO-KILL VEHICLE

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/384,804

(22) Filed: Mar. 10, 2003

(65) Prior Publication Data

US 2005/0132923 A1 Jun. 23, 2005

Related U.S. Application Data

(60) Provisional application No. 60/406,828, filed on Aug. 29, 2002.

(51) Int. Cl.
*B64D 1/02* (2006.01)
*F42B 12/66* (2006.01)
*F42B 12/02* (2006.01)

(52) U.S. Cl. ..... 89/1.11; 89/1.34; 102/473; 102/504

(58) Field of Classification Search ..... 102/477, 102/351, 357, 402, 405, 504, 473, 501, 517, 102/293, 474; 89/1.11, 1.1, 1.34; 244/3, 244/110 C
See application file for complete search history.

(56) References Cited

U.S. PATENT DOCUMENTS 1,198,035 A * 9/1916 Huntington ..... 102/504
1,229,421 A * 6/1917 Downs ..... 102/504
1,235,076 A * 7/1917 Stanton ..... 102/504
1,244,046 A 10/1917 Ffrench
1,300,333 A 4/1919 Berry
1,305,967 A 6/1919 Hawks
2,296,980 A * 9/1942 Carmichael ..... 102/504
2,308,683 A * 1/1943 Forbes ..... 102/504
2,322,624 A * 6/1943 Forbes ..... 102/504
2,337,765 A 12/1943 Nahirney
2,925,965 A 2/1960 Pierce
2,988,994 A 6/1961 Fleischer, Jr. et al.
3,332,348 A 7/1967 Myers et al.
3,565,009 A 2/1971 Allred et al.
3,656,433 A 4/1972 Thrailkill et al.
3,665,009 A 5/1972 Dickinson, Jr.
3,757,694 A 9/1973 Talley et al.

(Continued)

FOREIGN PATENT DOCUMENTS

DE 2206403 6/1973

(Continued)

OTHER PUBLICATIONS

English translation of DT 2206403 A, Held, Manfred, Germany Aug. 1973.*

(Continued)

*Primary Examiner*—James S Bergin
(74) *Attorney, Agent, or Firm*—Iandiorio Teska & Coleman

(57) ABSTRACT

A warhead including a hit-to-kill vehicle and a hub about the hit-to-kill vehicle including, packaged therein, a net and a plurality of rods held in a spaced relationship by the net for destroying a target when the net is deployed in the vicinity of the target in case the hit-to-kill vehicle misses the target.

4 Claims, 7 Drawing Sheets

U.S. PATENT DOCUMENTS 3,771,455 A 11/1973 Haas
3,796,159 A 3/1974 Conger
3,797,359 A 3/1974 Mawhinney et al.
3,818,833 A 6/1974 Throner, Jr.
3,846,878 A 11/1974 Monson et al.
3,851,590 A 12/1974 LaCosta
3,861,314 A 1/1975 Barr
3,877,376 A 4/1975 Kupelian
3,902,424 A 9/1975 Dietsch et al.
3,903,804 A 9/1975 Luttrell et al.
3,915,092 A 10/1975 Monson et al.
3,941,059 A 3/1976 Cobb
3,949,674 A 4/1976 Talley
3,954,060 A 5/1976 Haag et al.
3,977,330 A 8/1976 Held
4,026,213 A 5/1977 Kempton
4,036,140 A 7/1977 Korr et al.
4,089,267 A 5/1978 Mescall et al.
4,106,410 A 8/1978 Borcher et al.
4,147,108 A 4/1979 Gore et al.
4,172,407 A 10/1979 Wentink
4,210,082 A 7/1980 Brothers
4,211,169 A 7/1980 Brothers
4,231,293 A 11/1980 Dahn et al.
4,289,073 A 9/1981 Romer et al.
4,376,901 A 3/1983 Pettibone et al.
4,430,941 A 2/1984 Raech, Jr. et al.
4,455,943 A 6/1984 Pinson
4,516,501 A 5/1985 Held et al.
4,538,519 A 9/1985 Witt et al.
4,638,737 A 1/1987 McIngvale
4,655,139 A 4/1987 Wilhelm
4,658,727 A 4/1987 Wilhelm et al.
4,676,167 A 6/1987 Huber, Jr. et al.
4,745,864 A 5/1988 Craddock
4,770,101 A 9/1988 Robertson et al.
4,777,882 A 10/1988 Dieval
4,848,239 A 7/1989 Wilhelm
4,922,826 A 5/1990 Busch et al.
4,957,046 A 9/1990 Puttock
4,995,573 A 2/1991 Wallow
4,996,923 A 3/1991 Theising
H1047 H 5/1992 Henderson et al.
H1048 H 5/1992 Wilson et al.
5,182,418 A 1/1993 Talley
5,223,667 A 6/1993 Anderson
5,229,542 A 7/1993 Bryan et al.
5,313,890 A 5/1994 Cuadros
5,370,053 A 12/1994 Williams et al.
5,524,524 A * 6/1996 Richards et al. ..... 89/1.13
5,535,679 A 7/1996 Craddock
5,542,354 A 8/1996 Sigler
5,544,589 A 8/1996 Held
5,577,431 A 11/1996 Küsters
5,578,783 A 11/1996 Brandeis
5,583,311 A * 12/1996 Rieger ..... 89/1.11
5,622,335 A 4/1997 Trouillot et al.
D380,784 S 7/1997 Smith
5,670,735 A 9/1997 Ortmann et al.
5,691,502 A 11/1997 Craddock et al.
5,796,031 A 8/1998 Sigler
5,823,469 A 10/1998 Arkhangelsky et al.
5,929,370 A 7/1999 Brown et al.
5,936,191 A 8/1999 Bisping et al.
6,035,501 A 3/2000 Bisping et al.
6,044,765 A 4/2000 Regebro
6,116,544 A 9/2000 Forward et al.
6,173,922 B1 1/2001 Hoyt et al.
6,186,070 B1 2/2001 Fong et al.
6,276,277 B1 8/2001 Schmacker
6,279,478 B1 8/2001 Ringer et al. ..... 102/213
6,279,482 B1 8/2001 Smith et al. ..... 102/374
6,598,534 B2 7/2003 Lloyd et al.
6,622,632 B1 9/2003 Spivak
6,666,145 B1 12/2003 Nardone et al.
2003/0019386 A1 1/2003 Lloyd et al.
2004/0011238 A1 1/2004 Ronn et al.
2005/0016372 A1 * 1/2005 Kilvert ..... 89/1.34

FOREIGN PATENT DOCUMENTS

DE 3327043 A1 2/1985
DE 3722420 A1 * 1/1989
DE 3735426 A1 * 5/1989
DE 38 30 527 A1 3/1990
DE 3830527 A1 3/1990
DE 3834367 A1 * 4/1990
DE 3934042 A1 4/1991
DE 4437412 A1 * 9/1995
EP 270 041 A1 6/1988
EP 270 401 A1 6/1988
EP 655603 5/1995
EP 872705 A2 * 10/1998
EP 902250 A2 * 3/1999
FR 2 678 723 1/1993
FR 2678723 A1 1/1993
FR 2695467 A1 * 3/1994
GB 550001 12/1942
GB 2236581 4/1991
JP 1-296100 11/1989
WO WO97/27447 7/1997
WO WO 97/27447 7/1997
WO WO9930966 A1 * 6/1999

OTHER PUBLICATIONS

Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.
Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.
Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.
Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.
U.S. Appl. No. 10/162,498, filed Jun. 4, 2002, Lloyd.
U.S. Appl. No. 10/301,302, filed Nov. 21, 2002, Lloyd.
U.S. Appl. No. 10/301,420, filed Nov. 21, 2002, Lloyd.
U.S. Appl. No. 10/385,319, filed Mar. 10, 2003, Lloyd.
U.S. Appl. No. 10/370,892, filed Feb. 20, 2003, Lloyd.
U.S. Appl. No. 10/456,391, filed Jun. 5, 2003, Lloyd et al.
U.S. Appl. No. 10/456,777, filed Jun. 6, 2003, Lloyd.
U.S. Appl. No. 10/698,500, filed Oct. 31, 2003, Lloyd.
U.S. Appl. No. 10/685,242, filed Oct. 14, 2003, Lloyd.
FAS Military Analysis Network (http://www.fas.org/man/dod-101/sys/land/m546.htm): M546 APERS-T 105-mm, Jan. 21, 1999.
FAS Military Analysis Network (http://www.fas.org/man/dod-101/sys/land/bullets2.htm): Big Bullets for Beginners, Feb. 6, 2000.
Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.
Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.
U.S. Appl. No. 10/924,104, filed Aug. 23, 2004, Lloyd.
U.S. Appl. No. 10/938,355, filed Sep. 10, 2004, Lloyd.
U.S. Appl. No. 10/960,842, filed Oct. 7, 2004, Lloyd.
"Report of the American Physical Society Study Group on Boost-Phase Intercept Systems for National Missile Defense", Scientific and Technical Issues, Jul. 2003, pp. 241-248, http://www.aps.org/public_affairs/popa/reports/nmdfull-report.pdf.
Richard M. Lloyd, 'Alighned Rod Lethality Enhancement Concepts for Kill Vehicles,' AIAA/BMDD Technology Conference, Jun. 5th, Maastricht, Netherlands, 2001, pp. 1-12.

* cited by examiner

FIXED DEPLOYED NET FOR HIT-TO-KILL VEHICLE

RELATED APPLICATIONS

This application claims priority of Provisional Application Ser. No. 60/406,828 filed Aug. 29, 2002.

FIELD OF THE INVENTION

This invention relates to improvements in hit-to-kill vehicles.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads. Blast fragmentation and kinetic energy rod warheads are kill enhancement devices that are carried along on the "hit-to-kill" vehicle.

"Hit-to-kill" vehicles are typically launched into a position proximate a re-entry vehicle or other target via a missile such as the NMD System, THAAD, SM3, Trident or MX missile. The kill vehicle is navigable and designed to directly strike the re-entry vehicle to render it inoperable. Countermeasures, however, can be used to avoid the "hit-to-kill" vehicle. Moreover, nuclear or biological warfare bomblets and chemical warfare submunition payloads are carried by some targets threats. If the nuclear payload or more then one of these bomblets or chemical submunition payloads can survive, they would cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the nuclear target and, again, fall out, radiation, biological bomblets and/or chemical submunition payloads survive and cause heavy casualties. Also, a blast fragmentation warhead requires a fuse detection device that must be very accurate. Those types of accuracies in outer space are very difficult to achieve. Other warheads concepts need to be developed.

The textbooks by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, and "Physics of Direct Hit and Near Miss Warhead Technology", Volume 194, ISBN 1-56347-473-5, incorporated herein by this reference, provide additional details concerning "hit-to-kill" vehicles and blast fragmentation type warheads. Chapter 5 and Chapter 3 of these textbooks propose a kinetic energy rod warhead.

The primary components associated with theoretical kinetic energy rod warhead include a hull, a projectile core or bay in the hull including a number of individual lengthy cylindrical rods or projectiles, and an explosive charge in the hull about the projectile bay. When the explosive charge is detonated, the projectiles are deployed.

Two primary advantages of a kinetic energy rod warhead is that 1) it does not rely on precise navigation as is the case with "hit-to-kill" vehicles and 2) it provides better penetration than blast fragmentation type warheads. To date, however, kinetic energy rod warheads have not been widely accepted nor have they yet been fully deployed. Also, this concept requires a fuse to determine when to deploy the rods. Even though it does not need to be as accurate as the blast fragmentation warhead, it still must be incorporated into the vehicle.

Thus, those skilled in the art have endeavored to modify warheads such as the hit-to-kill vehicle to increase its lethality. Lockheed, for example, proposed a deployable fabric which surrounds the hit-to-kill vehicle and designed to impact a target in the case where the hit-to-kill vehicle does not directly strike and destroy the target. These concepts were only designed for a very small miss distance. Advanced countermeasure threats would defeat such a concept. And, with this design, it is possible for submunitions to escape destruction and thus the deployable fabric design did not gain wide acceptance. Also, the fabric does not penetrate thick payloads when compared to high density rods. The fabric concept is only required to slap the target with an impulse cause a delayed kill. Those types of kills are not accepted today and more lethal concepts are required.

SUMMARY OF THE INVENTION

It is therefore an object of this invention to provide a hit-to-kill vehicle which is able to destroy a nuclear target and/or its submunitions even if the main body of the hit-to-kill misses the target and/or fails to destroy a submunition.

It is a further object of this invention to provide such a hit-to-kill vehicle which exhibits the benefits and the advantages of both hit-to-kill vehicles and kinetic energy rods when engaging a complex counter threat.

This invention results from the realization that a higher lethality hit-to-kill vehicle is effected by the addition of a deployable net which positions a number of spaced kinetic energy rod warhead rods or projectiles in an array in space about the main body of the hit-to-kill vehicle to destroy nuclear targets and/or their submunitions even if the main body of the hit-to-kill vehicle does not. This concept does not require a fuse because the rods are held (fixed) in place. The spray pattern density is constant and fusing errors are not even considered. Since this concept is used in outer space, there no air drag on the deployed net. The net travels along with the kill vehicle killing the target given an off hit engagement.

This invention features a warhead comprising a hit-to-kill vehicle and a hub about the hit-to-kill vehicle including packaged therein a net, means for deploying the net, and a plurality of rods attached to the net for destroying a target when the net is deployed in the vicinity path of the target in case the hit-to-kill vehicle misses the target.

In one embodiment, the means for deploying the net includes an inflatable superstructure with a plurality of inflatable vanes and a circumferential inflatable ring. In another embodiment, the means for deploying the net includes thrusters attached to the periphery of the net.

The net may be round and include vertical members intersecting horizontal members or circular members intersecting axially extending members. Typically, the net includes intersecting members and the rods are disposed at the intersection of the members.

One method of destroying a target in accordance with this invention includes positioning a hit-to-kill vehicle in the trajectory path of a target and deploying a net including a plurality of rods held in a spaced relationship by the net for destroying the target in case the hit-to-kill vehicle misses the target.

One method of manufacturing a warhead in accordance with this invention features packaging a net, means for deploying the net, and a plurality of rods attached to the net in a hub and attaching the hub to a hit-to-kill vehicle. A plurality of rods are secured at the interstices of a net, the net is packaged in a hub and the hub is coupled to a hit-to-kill vehicle.

In the deployed configuration, the warhead of this invention includes a hit-to-kill vehicle, a hub about the hit-to-kill vehicle, a net extending outward from the hub, and a plurality of rods attached to the net for destroying a target when the net is deployed in the vicinity path of the target in case the hit-to-kill vehicle misses the target.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
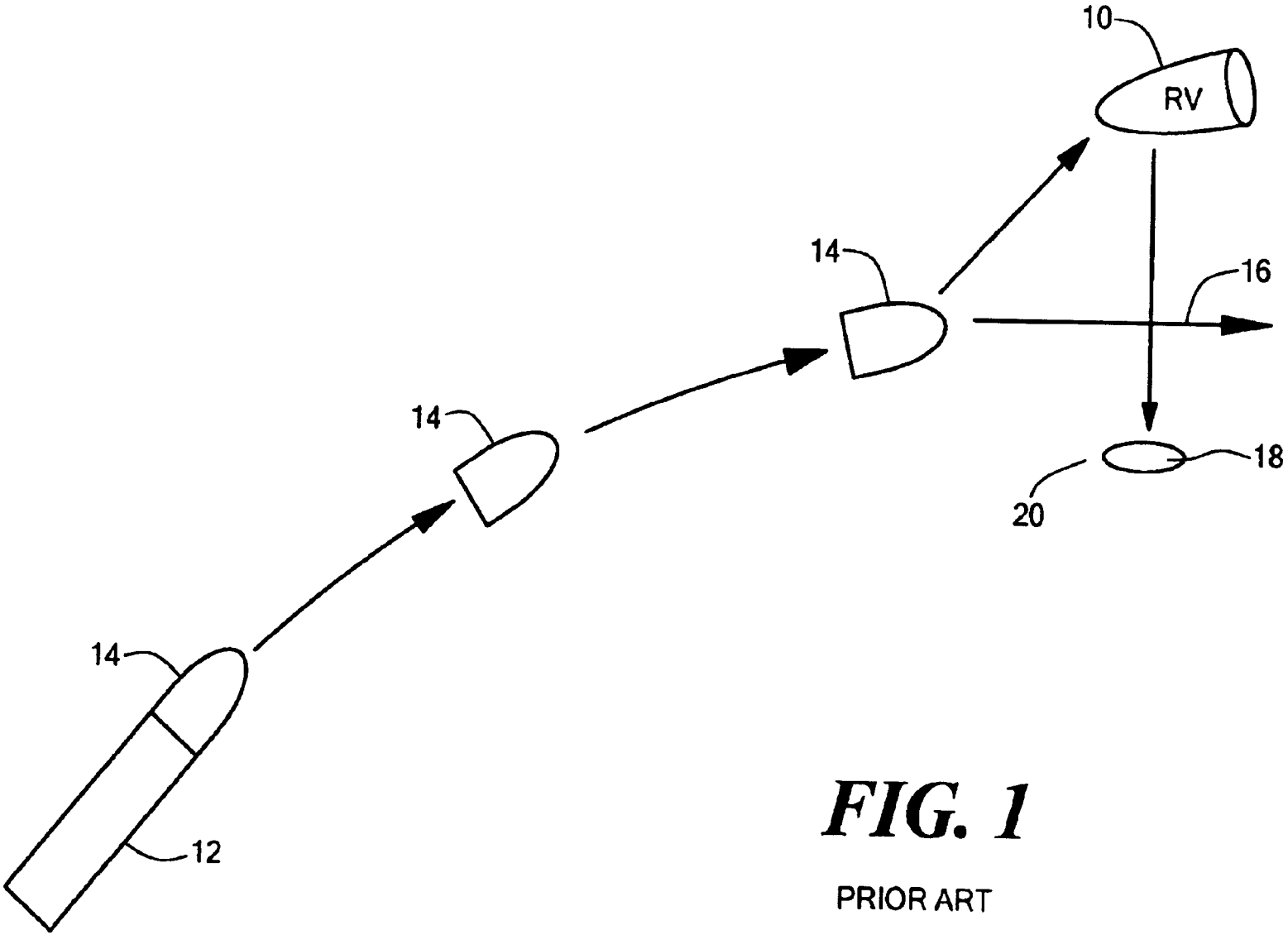
FIG. 1 PRIOR ART
FIG. 1 is a schematic view showing the deployment of a prior art hit-to-kill vehicle.
Figure 2:
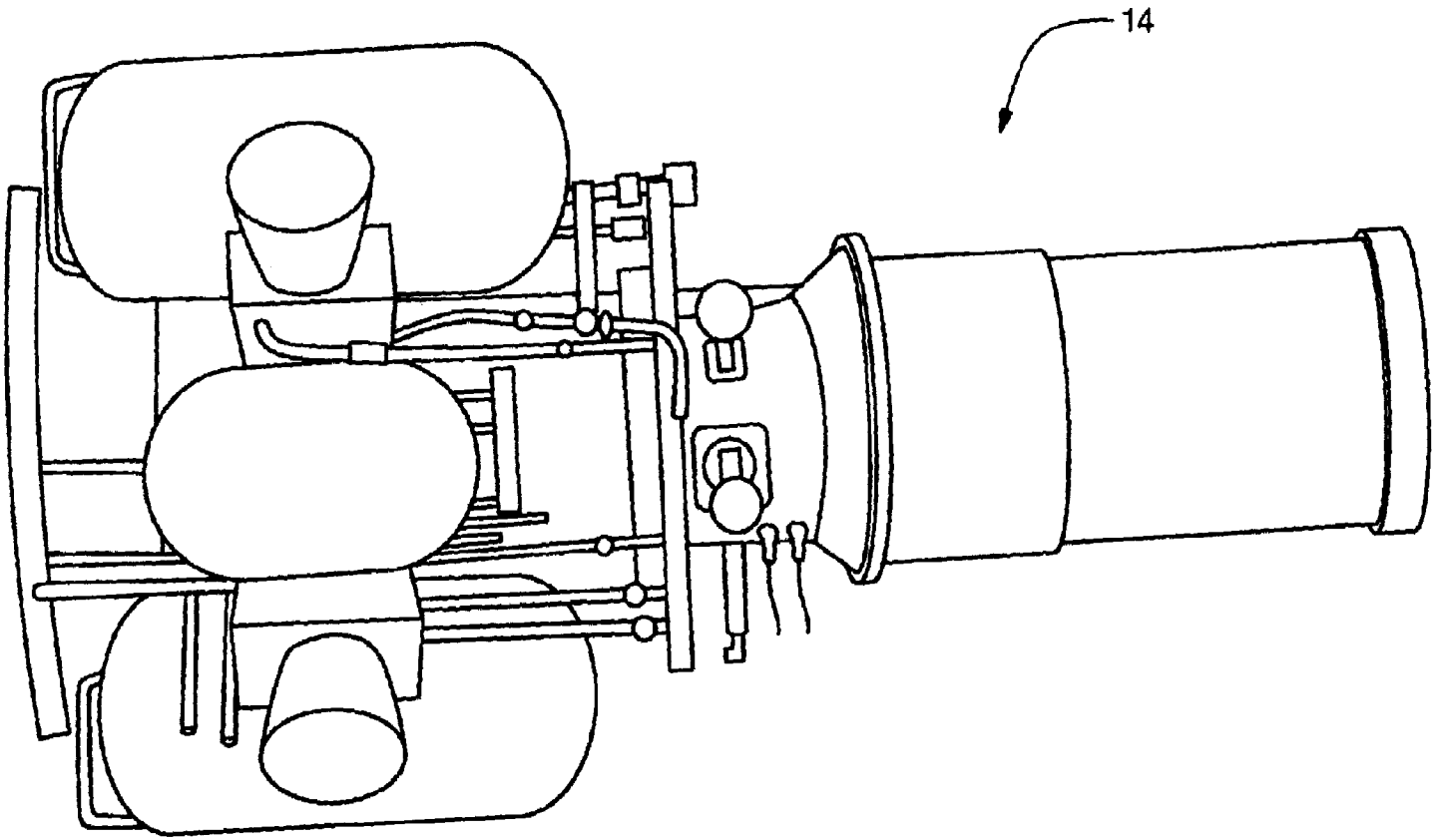
FIG. 2 PRIOR ART
FIG. 2 is a schematic three dimensional view of a prior art hit-to-kill vehicle.

As discussed in the background section above, hit-to-kill vehicles are typically launched into a position proximate re-entry vehicle 10, FIG. 1 or other target via missile 12. Hit-to-kill vehicle 14 is navigatable and designed to strike re-entry vehicle 10 to render it inoperable. Counter measures, however, can be used to avoid kill vehicle 14. Vector 16 shows kill vehicle 14 missing re-entry vehicle 10. Moreover, nuclear or biological bomblets and chemical submunition payloads 18 are carried by some threats and one or more of these bomblets or chemical submunition payloads 18 can survive, as shown at 20, and cause heavy casualties even if kill vehicle 14 does accurately strike target 10. FIG. 2 shows hit-to-kill vehicle 14 in more detail.

Figure 3:
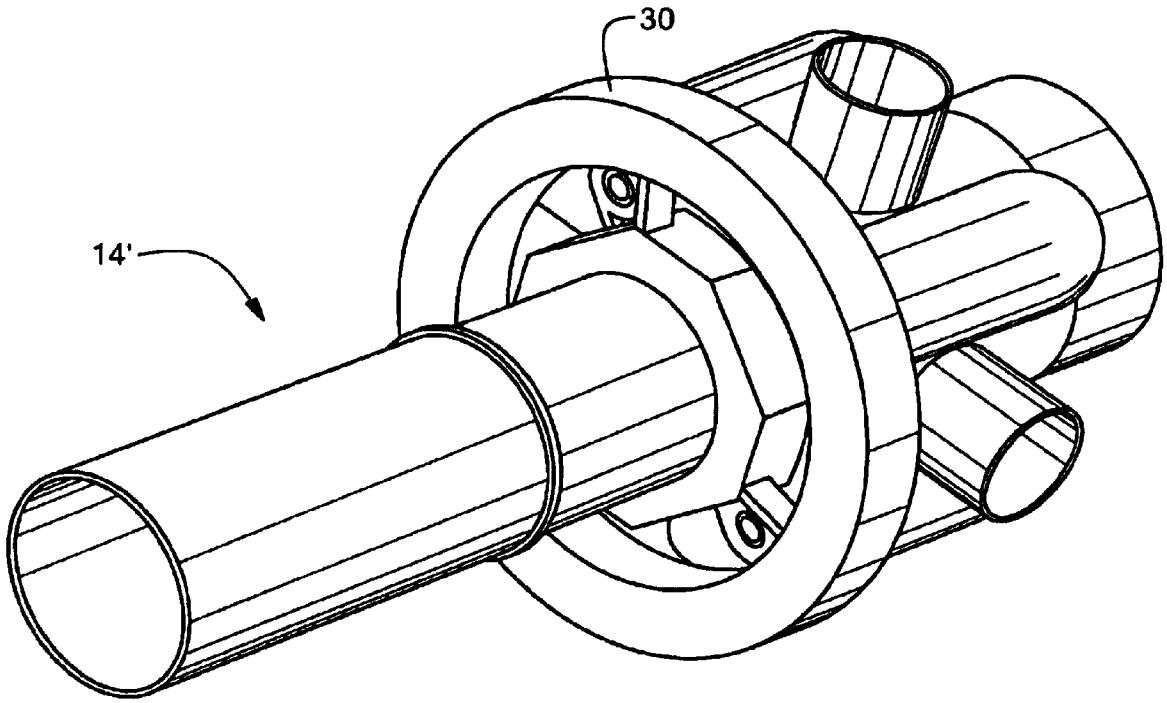
FIG. 3 is a schematic three dimensional view showing the modified hit-to-kill vehicle of the subject invention.

In this invention, hit-to-kill 14', FIG. 3 is modified to include hub 30 encircling vehicle 14. Hub 30 includes a net, means for deploying the net, and a plurality of kinetic energy rod warhead rods packaged therein preferably secured to the net at the interstices thereof.

Figure 4:
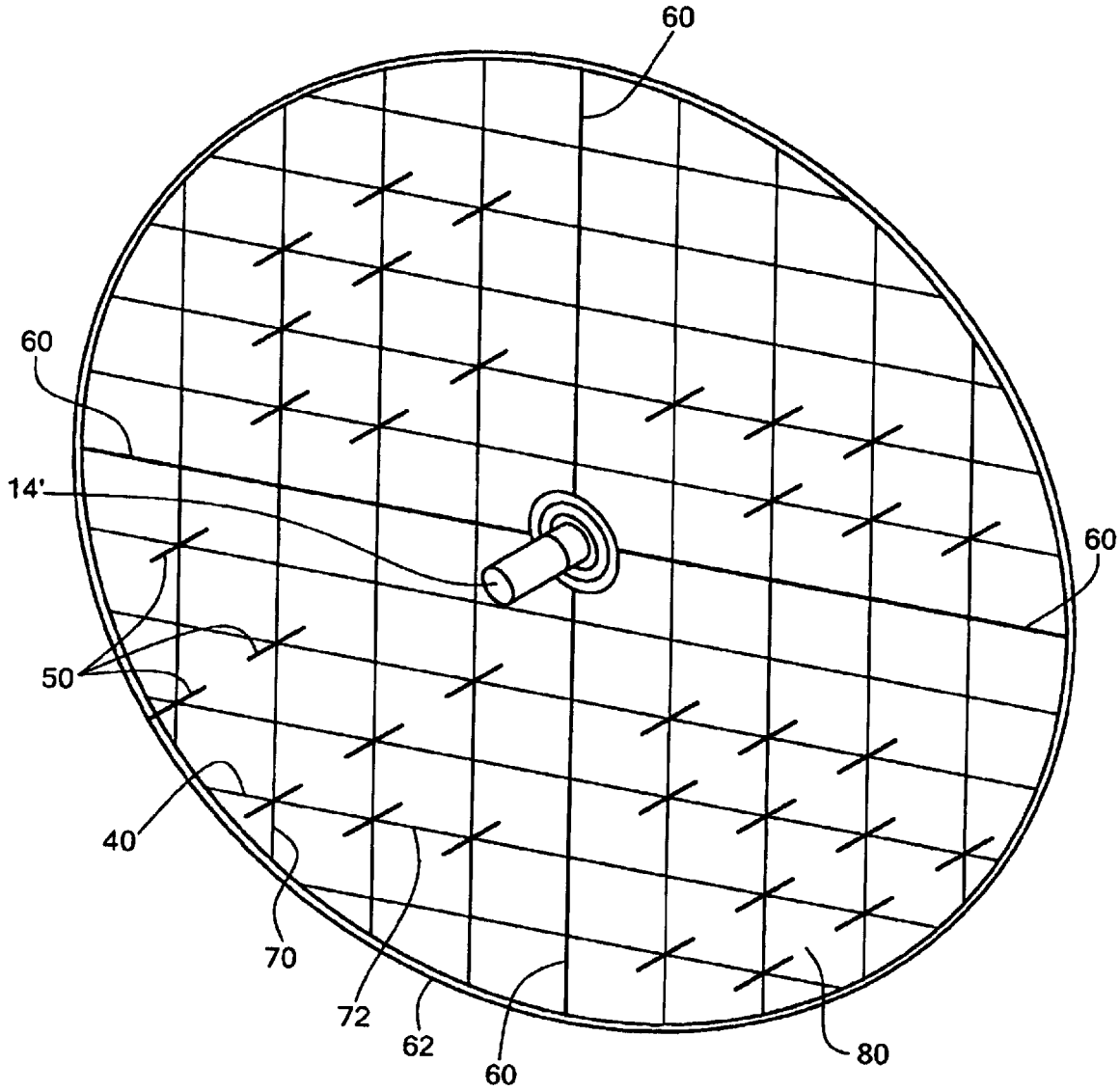
FIG. 4 is a schematic three dimensional view showing the deployment of the net of the subject invention about the hit-to-kill vehicle.

FIG. 4 shows net 40 deployed and rods 50 held in a spaced relationship by the net. In this embodiment, the means for deploying net 40 is an inflatable superstructure including inflatable vanes 60 and circumferential inflatable ring 62. In this example, 20 foot diameter net 40 is round and includes vertical nylon members 70 intersecting horizontal nylon members 72. Rods 50 are secured at the intersection of all or most of such members. The primary purpose of net 40 is to orient rods 50 in a spaced relationship in order to destroy a target or submunitions not destroyed by the main body of hit-to-kill vehicle 14'. In the example shown in FIG. 4, fabric layer 80 may also be used in connection with net 40. A gas generator connected to the inflatable superstructure inflates the vanes 60 and ring 62.

The advantage of this system over a kinetic energy rod warhead is that the density of the rods in space is held constant. In a kinetic energy rod warhead, in contrast, the density of the rods deployed as projectiles decreases rapidly after deployment. Those skilled in the art will know how to select the appropriate density for the rods by fabricating nets of different configurations.

Figure 5:
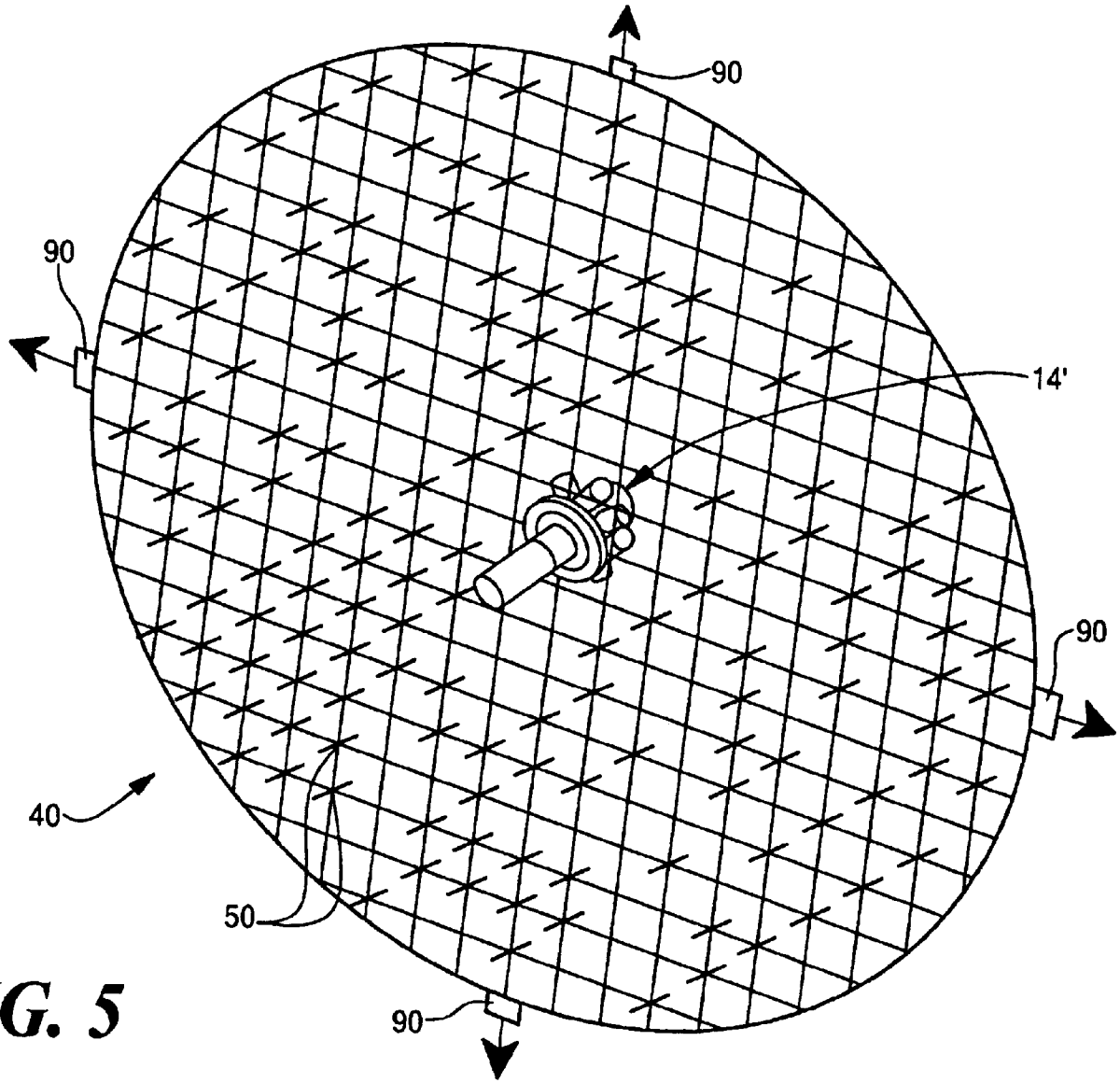
FIG. 5 is a schematic three dimensional view showing another embodiment of a deployable net in accordance with the subject invention.
Figure 6:
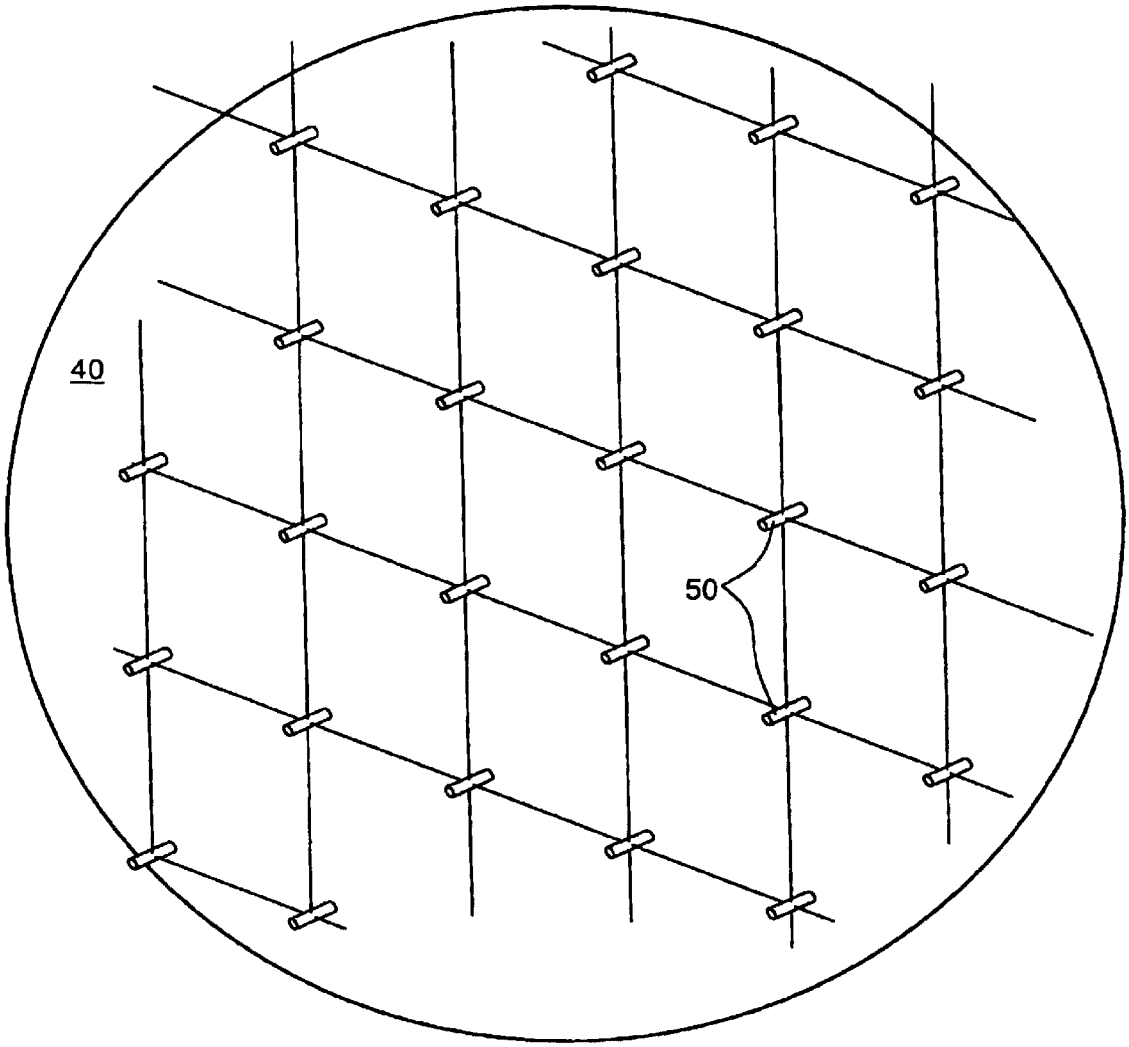
FIG. 6 is a schematic three dimensional view showing a portion of the net of FIG. 5.

In the embodiment of FIGS. 5–6, small thrusters 90, attached to the periphery of net 40 are the means for deploying net 40. Rods 50 may be made of titanium and cylindrical in shape although the other rod shapes disclosed in U.S. patent application Ser. No. 10/162,498, incorporated herein by this reference, may also be used.

Figure 7:
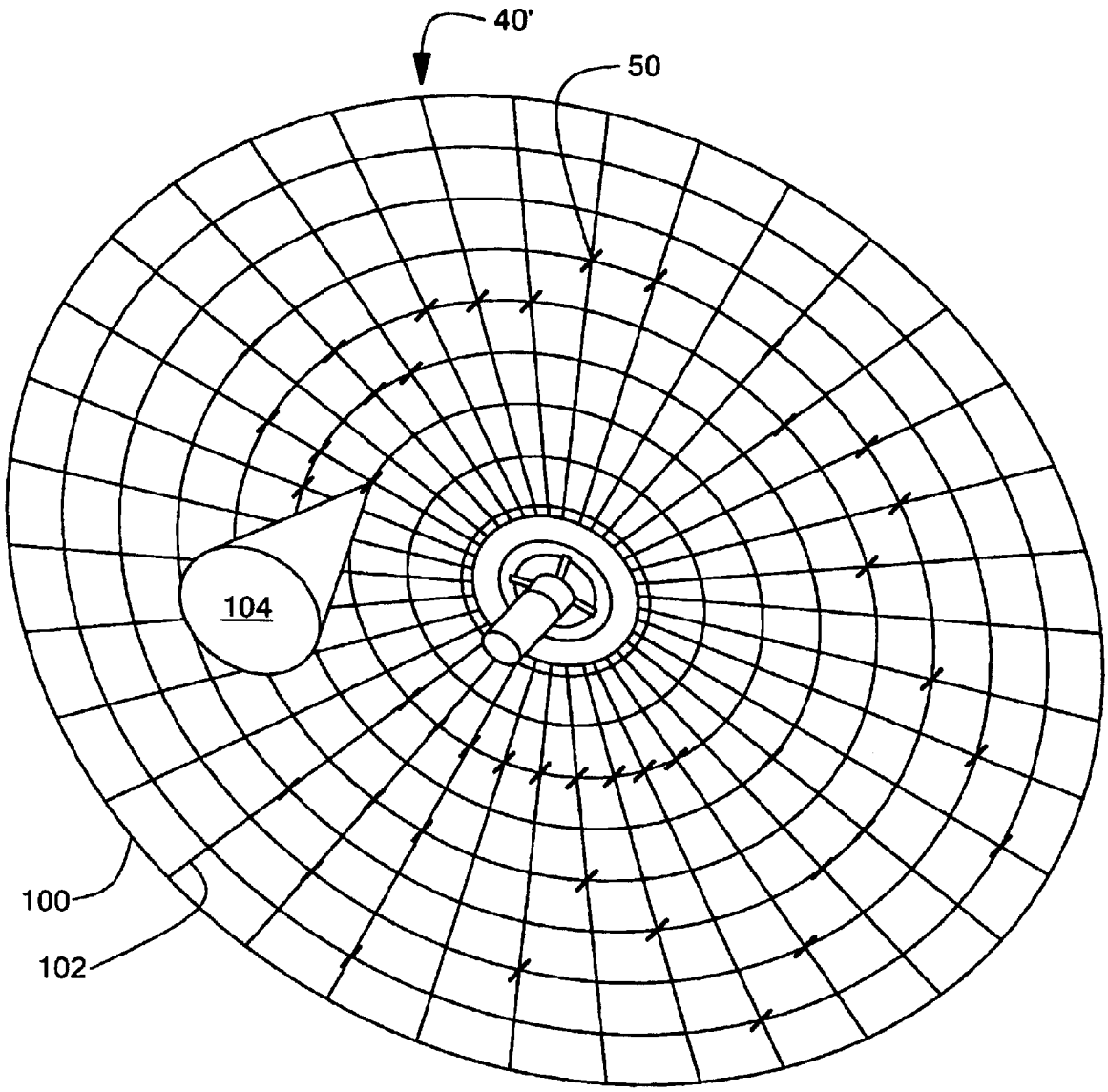
FIG. 7 is a schematic three dimensional view showing another design for a deployable net in accordance with the subject invention.

In FIG. 7, net 40' includes circular members 100 intersecting radially extending members 102. As shown, the main body of the hit-to-kill vehicle has missed target 104 but since the net is deployed in the vicinity of the target, rods or projectiles 50, held in a fixed spaced position in space, will destroy target 104.

The net may be deployed by thrusters as discussed above with reference to FIG. 5 or by the addition of an inflatable superstructure as discussed above with reference to FIG. 4, and/or a combination of both designs. Thus, the hit-to-kill vehicle of the subject invention has enhanced lethality due to the addition of the kinetic energy rods held in a fixed spaced relation by the net and is thus able to destroy a nuclear target and/or its submunitions even if the main body of the hit-to-kill vehicle misses the target and/or fails to destroy a submunition. The result is a system which exhibits the benefits and advantages of both hit-to-kill vehicles and kinetic energy rod warheads. Fusing is typically not required as is the case with the Lockheed fabric design.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A warhead comprising:

a hit-to-kill vehicle; and a hub about the hit-to-kill vehicle including packaged therein:

a net, an inflatable superstructure including a plurality of vanes and an inflatable ring for deploying the net, and a plurality of rods attached to the net held at a constant spaced relationship with respect to one another in space by the net and the inflatable superstructure for destroying a target when the net is deployed in the vicinity of the target in case the hit-to-kill vehicle misses the target.

2. The warhead of claim 1 in which the net is round and includes vertical members intersecting horizontal members.

3. The warhead of claim 1 in which the net is round and includes circular members intersecting radially extending members.

4. The warhead of claim 1 in which the net includes intersecting members and the rods are disposed at the intersection of the members.

* * * * *